US006662765B2

(12) United States Patent
Araki

(10) Patent No.: US 6,662,765 B2
(45) Date of Patent: Dec. 16, 2003

(54) TWO-STROKE INTERNAL COMBUSTION ENGINE

(75) Inventor: Tsuneo Araki, Tokyo (JP)

(73) Assignee: Kioritz Corporation, Tokyo (JP)

( * ) Notice: Subject to any disclaimer, the term of this patent is extended or adjusted under 35 U.S.C. 154(b) by 44 days.

(21) Appl. No.: 10/100,197

(22) Filed: Mar. 18, 2002

(65) Prior Publication Data

US 2002/0134326 A1 Sep. 26, 2002

(30) Foreign Application Priority Data

Mar. 21, 2001 (JP) ..... 2001-080737

(51) Int. Cl.[7] ..... F02B 25/16; F02F 3/24
(52) U.S. Cl. ..... 123/73 A; 123/73 AA
(58) Field of Search ..... 123/73 A, 73 AA, 123/73 PP, 73 AV

(56) References Cited

U.S. PATENT DOCUMENTS

| | | | | | |
|---|---|---|---|---|---|
| RE30,425 | E | * | 11/1980 | Boyesen | 123/73 AA |
| 4,318,373 | A | * | 3/1982 | Soubis | 123/73 A |
| 4,352,343 | A | * | 10/1982 | Batoni | 123/73 A |
| 4,383,503 | A | * | 5/1983 | Griffiths | 123/73 A |
| 4,920,933 | A | * | 5/1990 | Iwai et al. | 123/73 A |
| 5,020,483 | A | * | 6/1991 | Watanabe | 123/73 A |
| 5,178,104 | A | * | 1/1993 | Ito et al. | 123/73 A |
| 5,231,958 | A | * | 8/1993 | Takahashi et al. | 123/73 A |
| 5,379,732 | A | * | 1/1995 | Mavinahally et al. | 123/73 AA |
| 5,505,166 | A | * | 4/1996 | Katoh | 123/73 A |
| 5,628,295 | A | * | 5/1997 | Todero et al. | 123/73 AA |
| 6,564,760 | B2 | * | 5/2003 | Laydera-Collins | 123/73 AA |

OTHER PUBLICATIONS

Japanese Publication No. 05–033657 and English Patent Abstracts of Japanese patent Publication No. 05–033657 date Feb. 9, 1993; Application No. 03–212994, filed Jul. 7,1991; Applicant: Mitsubishi Heavy Ind Ltd.; Inventor: Nakachi Masaaki, 7 pages.

Japanese Publication No. 09–125966 and English Patent Abstracts of Japanese patent, Publication No. 09–125966 dated May 13, 1997; Application No. 07–280862, filed Oct. 27, 1995; Applicant: Komatsu Zenoah Co.; Inventor: Noguchi Sukenori, 8 pages.

* cited by examiner

*Primary Examiner*—Henry C. Yuen
*Assistant Examiner*—Jason Benton
(74) *Attorney, Agent, or Firm*—Baker Botts LLP

(57) ABSTRACT

A two-stroke internal combustion engine which is capable of minimizing the quantity of blow-by or the quantity of air-fuel mixture to be discharged without being utilized for the combustion, of improving the fuel consumption and power of the engine, of reducing the content of poisonous components in the exhaust gas, and of reducing the manufacturing cost, without extensively altering the conventional engine. A through-hole or a communication groove is provided at the skirt portion of a piston to thereby enabling a scavenging inlet port to be communicated with the crank chamber. In the descending stroke, combustion exhaust gas from the combustion actuating chamber is enabled to be introduced, via a scavenging outlet port provided at a downstream end of the scavenging passageway, into the scavenging passageway while closing the scavenging inlet port at the skirt portion of the piston. In synchronization with the descending stroke, an air-fuel mixture is subsequently introduced from the crank chamber, via the through-hole or the communication groove, into the scavenging passageway. The combustion exhaust gas in the scavenging passageway is introduced into the combustion actuating chamber prior to the introduction of air-fuel mixture.

4 Claims, 18 Drawing Sheets

TWO-STROKE INTERNAL COMBUSTION ENGINE

BACKGROUND OF THE INVENTION

1. Technical Field of the Invention

The present invention relates to a two-stroke internal combustion engine which is suited for use in a portable power working machine, and in particular to a two-stroke internal combustion engine which is capable of minimizing the quantity of so-called blow-by or the quantity of air-fuel mixture to be discharged without being utilized for the combustion.

2. Description of the Related Art

An ordinary small air-cooled two-stroke internal combustion engine which is conventionally used in a portable power working machine, such as a chain saw or brush cutter, is constructed such that an ignition plug is disposed at the head portion of the cylinder, and an intake port, a scavenging port and an exhaust port, which are opened and closed by a piston, are provided at the trunk portion of the cylinder. According to this two-stroke internal combustion engine, one cycle of the engine is accomplished by two strokes of the piston without undergoing a stroke exclusively assigned to the intake or exhaust.

More specifically, in the ascending stroke of the piston, air-fuel mixture is introduced from the intake port into a crank chamber disposed below the piston. During the subsequent descending stroke, the air-fuel mixture is precompressed, and compressed gas mixture is then blown into a combustion actuating chamber (though it may be also called a combustion chamber, actuating chamber, cylinder chamber, etc., these chambers are generically referred to as combustion actuating chamber in the present specification) which is disposed above the piston, thereby enabling waste combustion gas to be discharged from the exhaust port. In other words, since the scavenging of the waste combustion gas is effected by making use of the gas flow of the air-fuel mixture, the unburned air-fuel mixture is more likely to be mixed into the combustion gas (exhaust gas), thereby increasing the quantity of so-called blow-by or the quantity of air-fuel mixture to be discharged into the atmospheric air without being utilized for the combustion. Because of this, two-stroke internal combustion engines are not only inferior in fuel consumption but also disadvantageous in that a large amount of poisonous components such as HC (unburned components in fuel) and CO (incomplete combustion components in fuel) are included in the exhaust gas when compared to four-stroke engines. Therefore, even if the two-stroke engine is small in capacity, the influence of these poisonous components on the environmental contamination should not be disregarded.

With a view to addressing these problems, various proposals on the two-stroke internal combustion engine have been suggested. The proposals have included the introduction of air into the combustion actuating chamber prior to the introduction of air-fuel mixture so as to scavenge the combustion gas (for example, Japanese Patent Unexamined Publications H9-125966 and H5-33657).

In such conventional air-preintroduction type two-stroke internal combustion engines, however, air inlet passageways or check valves are required to be separately installed, so the resulting engine may be complicated in structure, and inevitably result in a sharp increase in manufacturing cost.

Additionally, since air is caused to be excessively introduced into the combustion actuating chamber, the combustion stability may easily deteriorate, thus creating problems, such as difficulties in the engine setting. Accordingly, there exists a need in the art for a two-stroke engine which can overcome the aforementioned disadvantages associated with the conventional two-stroke engines.

BRIEF SUMMARY OF THE INVENTION

An object of the present invention is to provide an air-preintroduction type two-stroke internal combustion engine which is capable of minimizing the quantity of so-called blow-by or the quantity of air-fuel mixture discharged without being utilized for combustion.

Another object of the present invention is to provide an air-preintroduction type two-stroke internal combustion engine with improved fuel consumption and engine power.

Yet another object of the present invention is to provide an air-preintroduction type two-stroke internal combustion engine capable of reducing the amount of poisonous components in the exhaust gas.

Still another object of the present invention is to reduce the manufacturing cost of an air-preintroduction type two-stroke internal combustion engine, without extensively altering its conventional structure.

These and other objects of the present invention, which will become apparent with reference to the disclosure herein, are accomplished by the two-stroke internal combustion engine according to the present invention, which includes one or more pairs of Schnürle-type scavenging passageways, each allowing the combustion actuating chamber disposed above a piston to communicate with the crank chamber. The scavenging passageways are symmetrically provided on both sides of the longitudinal section that figuratively divides an exhaust port into two equal parts. A through-hole or a communication groove is provided at a skirt portion of the piston to thereby enable a scavenging inlet port provided at an upper end of the scavenging passageway to communicate with the crank chamber. In the descending stroke of the piston, combustion exhaust gas originating from the combustion actuating chamber is enabled to be introduced, via a scavenging outlet port provided at the downstream end of the scavenging passageway, into the scavenging passageway while closing the scavenging inlet port at the skirt portion of the piston. In synchronization with the descending stroke of the piston, the air-fuel mixture may be introduced from the crank chamber, via the through-hole or the communication groove, into the scavenging passageway. The combustion exhaust gas existing inside the scavenging passageway is designed to be introduced into the combustion actuating chamber prior to the introduction thereinto of the air-fuel mixture.

In a preferred embodiment, in the descending stroke of the piston, the scavenging outlet port is opened a moment after the exhaust port has been opened, which is followed by the opening of the scavenging inlet port through the through-hole or the communication groove.

Alternatively, the two-stroke internal combustion engine may include a pair of first Schnürle-type scavenging passageways located close to the exhaust port and a pair of second Schnürle-type scavenging passageways located away from the exhaust port, each passageway allowing the combustion actuating chamber, disposed above the piston, to communicate with the crank chamber. The scavenging passageways are symmetrically provided on both sides of the longitudinal section that figuratively divides the exhaust port into two equal parts. A through-hole or a communication groove is provided at a skirt portion of the piston to thereby enable a second scavenging inlet port, provided at an upper end of the second Schnürle-type scavenging passageway, to communicate with the crank chamber. The upper end of the first scavenging passageway communicates via a throttle passageway with the second scavenging passageway. In the descending stroke of the piston, combustion exhaust gas originating from the combustion actuating chamber is introduced, via the first scavenging outlet port provided at the downstream end of the first scavenging passageway, into the first scavenging passageway, while the second scavenging inlet port is closed at the skirt portion of the piston. In synchronization with the descending stroke of the piston, the air-fuel mixture fed from the crank chamber is subsequently introduced into the second scavenging passageway via the through-hole or the communication groove, as well as through the second scavenging inlet port, and also into the first scavenging passageway through the throttle passageway. The combustion exhaust gas existing inside the first scavenging passageway is designed to be introduced into the combustion actuating chamber prior to the introduction thereinto of the air-fuel mixture.

In a preferred embodiment, in the descending stroke of the piston, the scavenging outlet port is opened a moment after the exhaust port has been opened, which is followed by the opening of the second scavenging inlet port via the through-hole or the communication groove and is followed by the opening of the second scavenging outlet port.

According to the preferred embodiments of two-stroke internal combustion engine of the present invention as described above, the air-fuel mixture supplied from the air-fuel mixture-generating means, e.g., a carburetor, is received and stored in the crank chamber in the ascending stroke of the piston.

When the air-fuel mixture inside the combustion actuating chamber, disposed above the piston, explodes and burns after being ignited, combustion gas is generated and the piston is pushed downward. In this descending stroke of the piston, the air-fuel mixture existing inside the crank chamber is compressed by the piston, and at the same time, the exhaust port is opened to permit the combustion exhaust gas to be discharged from the exhaust port.

As the piston further descends, the scavenging port, provided at the downstream end of each of the scavenging passageways, is opened. At this moment, the scavenging inlet port of each of the scavenging passageways is closed by the skirt portion of the piston. Since the combustion gas (combustion exhaust gas) pressure existing inside the combustion actuating chamber due to the aforementioned explosive burning is higher than the pressure of the air-fuel mixture inside the scavenging passageways, part of the combustion exhaust gas is permitted to blow down from the scavenging outlet port and hence is permitted to be introduced into and stored in the scavenging passageways.

As the piston still further descends, the scavenging inlet port is opened via the through-hole or the communication groove provided at the skirt portion of the piston, thereby allowing the air-fuel mixture that has been pre-compressed in the crank chamber to be introduced into the scavenging passageway. As a result, the combustion exhaust gas existing inside the scavenging passageway is pushed out by the air-fuel mixture introduced as mentioned above into the scavenging passageway, thereby enabling the combustion exhaust gas to be blown out from the scavenging outlet port toward the combustion actuating chamber. Due to the scavenging gas flow of the combustion exhaust gas thus blown out, the combustion exhaust gas existing inside the combustion actuating chamber is pushed out therefrom toward the exhaust port. Furthermore, following the combustion exhaust gas flow, the air-fuel mixture is also permitted to flow into the combustion actuating chamber, thereby completely forcing the combustion exhaust gas that has been introduced in advance into the combustion actuating chamber to flow toward the exhaust port.

In the preferred embodiment, the scavenging (by making use of the combustion exhaust gas) is performed by deliberately delaying the scavenging-initiating timing from the exhaust-initiating timing (the timing to open the exhaust port). In succession to this scavenging, a high-pressure fresh air (air-fuel mixture), which has been pre-compressed, is enabled to be introduced at a stretch into the combustion actuating chamber.

According to the conventional two-stroke internal combustion engine where the air-fuel mixture is employed as a scavenging flow, a fairly large quantity of air-fuel mixture is permitted to blow by, since the portion indicated by the hatched region (area) in FIG. 13 corresponds to the quantity of so-called blow-by of fresh air (air-fuel mixture).

According to the preferred embodiments of the two-stroke internal combustion engine of the present invention as described above, the quantity of blow-by of air-fuel mixture can be greatly reduced since the combustion exhaust gas is employed in place of the air-fuel mixture as a scavenging flow, which results in that the portion indicated by the hatched region (area) in FIG. 12 corresponds to the quantity of so-called blow-by of fresh air (air-fuel mixture). Therefore, according to the two-stroke internal combustion engine of the present invention, the quantity of so-called blow-by or the quantity of air-fuel mixture to be discharged without being utilized for the combustion can be reduced to a minimum, thus making it possible to improve the fuel consumption and engine power, and to minimize the amount of poisonous components in the exhaust gas.

Furthermore, the two-stroke internal combustion engine of the present invention can be manufactured by slightly modifying the piston (drilling a through-hole, etc. therein), so that the conventional engine structure would not be significantly altered. Therefore, it is possible to reduce the manufacturing cost of the engine to a minimum.

According to the prior art, it has been generally tried to narrow the timings of suction and exhaust (timing area) so as to reduce the amount of exhaust gas as a whole (the engine power would be inevitably lowered) in order to minimize the presence of poisonous substances in the exhaust gas (exhaust emission). According to the present invention, it is no longer absolutely required to reduce the amount of exhaust gas. Moreover, since air is no longer permitted to be introduced into the engine, it is now possible to prevent combustion stability from deteriorating and to facilitate the engine setting.

In accordance with the invention, the objects as described above have been met, and the need in the art for a two-stroke engine that has low amount of poisonous components in the exhaust gas, improved fuel consumption and combustion stability, has been satisfied.

DETAILED DESCRIPTION OF THE PREFERRED EMBODIMENTS

Specific embodiments of a two-stroke internal combustion engine according to the present invention will be further explained with reference to the drawings.

Figure 8:
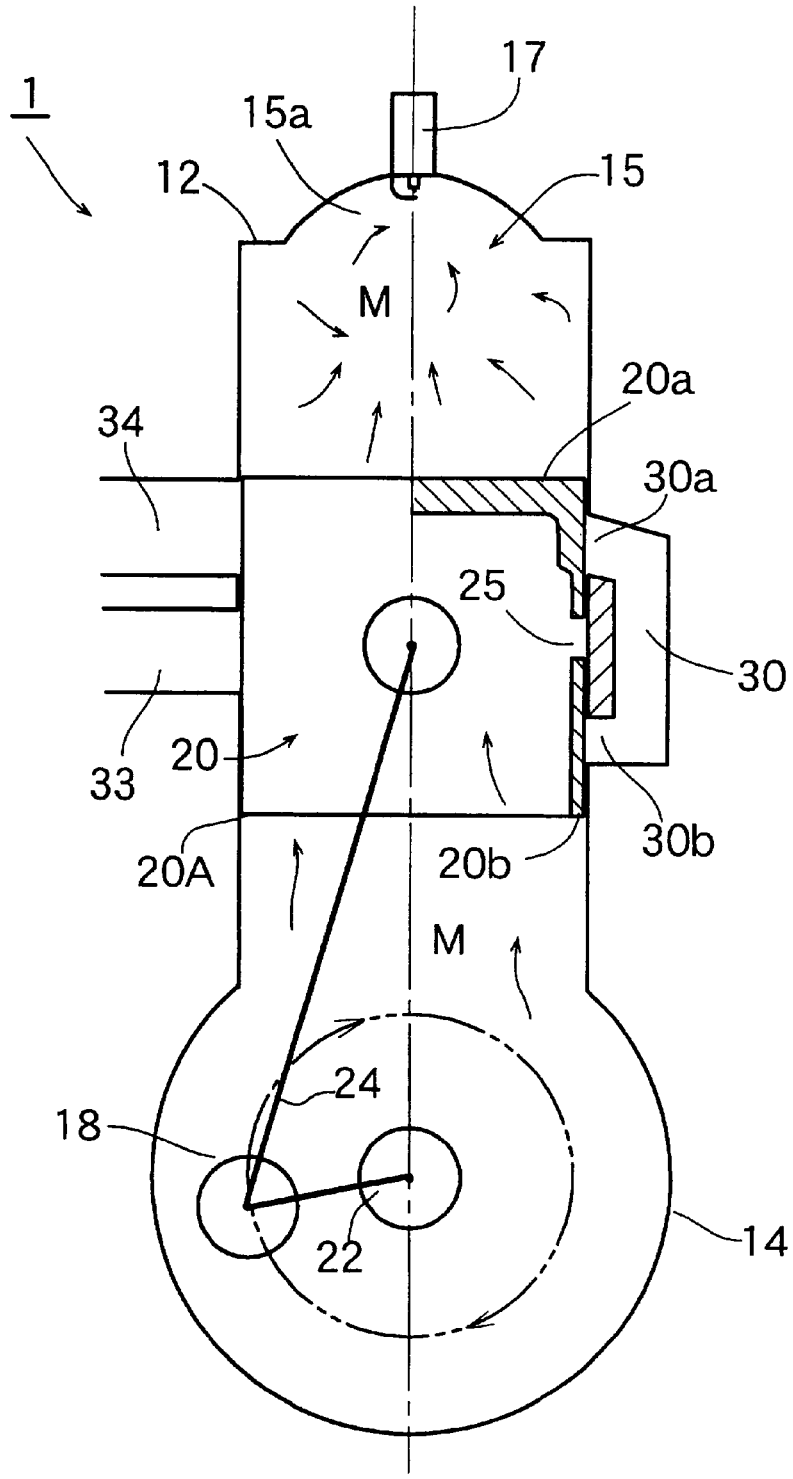
FIG. 8 is a longitudinal sectional view schematically illustrating a state wherein the piston of the two-stroke internal combustion engine of FIG. 1 is ascended to such an extent that the scavenging outlet port as well as the scavenging inlet port thereof are closed.
Figure 9:
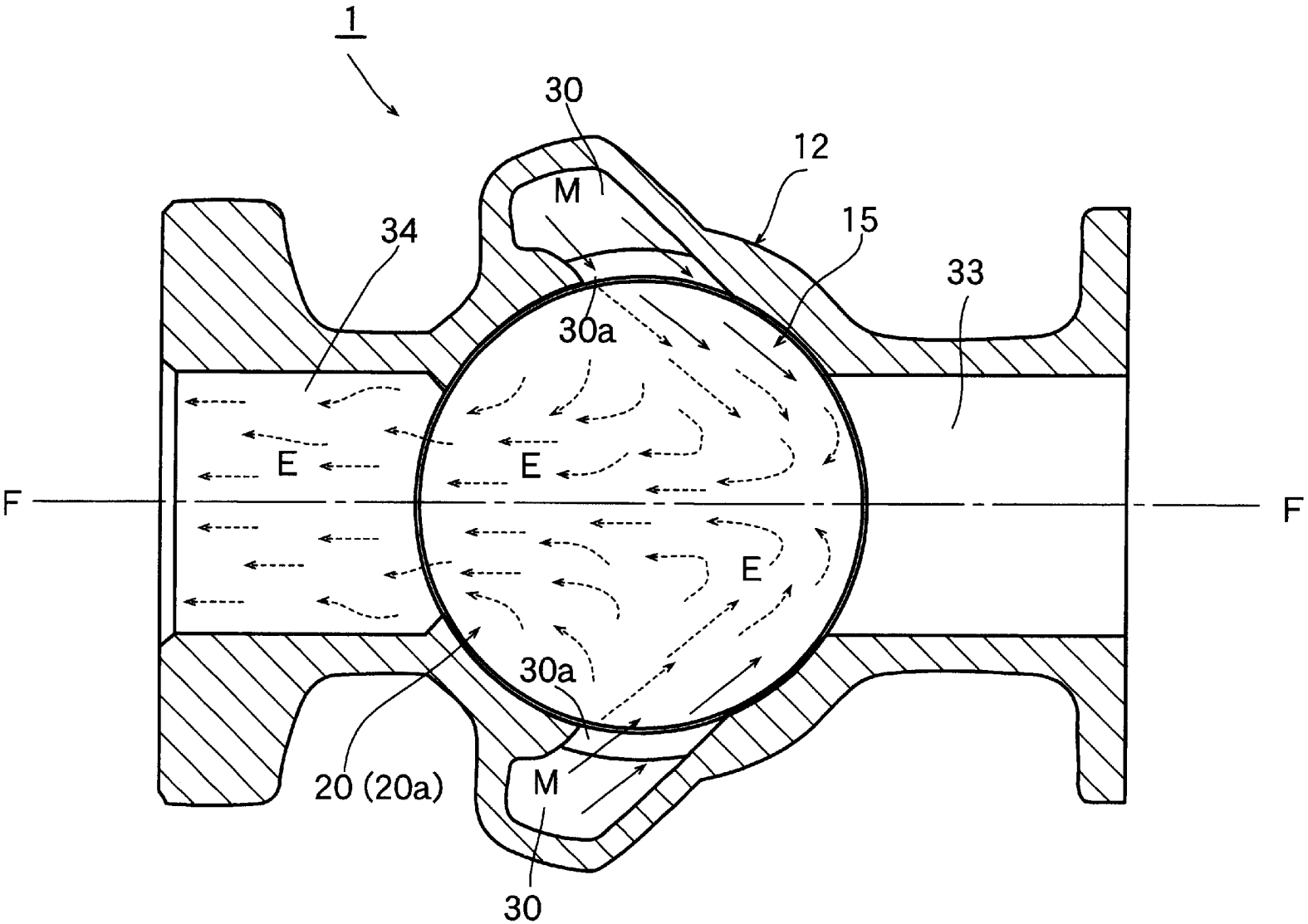
FIG. 9 is a cross-sectional view illustrating the two-stroke internal combustion engine shown in FIG. 1.

FIGS. 1 through 8 respectively illustrate a longitudinal sectional view schematically illustrating one embodiment of the two-stroke internal combustion engine according to the present invention. FIG. 9 is a schematic cross-sectional view taken along the exhaust port.

For easier explanation, in FIGS. 1 through 8, an exhaust port 34 and an intake port 33 are shown such that they are disposed on the same side. Also, in FIG. 9, the exhaust port 34 and the intake port 33 are shown such that they are positioned at the same level. However, as a matter of fact, the intake port 33 is preferably displaced, in the horizontal direction, from the exhaust port 34 at an angle of 180° and also placed, in the vertical direction, lower than the exhaust port 34. Furthermore, scavenging passageways 30 are both preferably displaced from the intake port 33 at an angle of 90°.

Referring to FIGS. 1–8, the two-stroke internal combustion engine 1 is formed of a small air-cooled two-stroke gasoline engine of binary scavenging type, which is adapted to be employed in a portable working machine. The engine 1 includes a cylinder 12 in which a piston 20 is fittingly inserted, and a crankcase 14 axially supporting a crank shaft 22 for reciprocally moving the piston 20 up and down via a connecting rod 24. The cylinder 12 is provided, on the outer circumferential wall thereof, with a large number of cooling fins (not illustrated ), and, at the head portion thereof, with a squish-dome shape (semi-spherical) combustion chamber 15*a* constituting the combustion actuating chamber 15. An ignition plug 17 is protruded into the combustion chamber 15*a*.

The exhaust port 34 is attached to one side (the left side in FIG. 9) of the cylinder's trunk portion and the intake port 33 is attached to the other side (the right side in FIG. 9) of the trunk portion. A pair of right and left scavenging passageways 30 are symmetrically provided on both sides of the longitudinal section F—F (FIG. 9) which figuratively divides the exhaust port 34 into two equal parts so as to permit the combustion actuating chamber 15, disposed above the piston 20, to communicate with the crank chamber 18 defined by the crankcase 14. A pair of scavenging outlet ports 30*a* both opening to the combustion actuating chamber 15 are provided, respectively, at the upper end (a downstream end) of each of the scavenging passageways 30, and a pair of scavenging inlet ports 30*b* both opening to the crank chamber 18 are provided, respectively, at the lower end (an upstream end) of each of the scavenging passageways 30.

The scavenging outlet ports 30*a* are disposed at a level which is lower than the exhaust port 34 by a distance of "h", so that the scavenging outlet ports 30*a* are enabled to open a moment later, i.e., a crank angle corresponding to the distance of "h" (for example, about 10 degrees) after the opening of the exhaust port 34 in the descending stroke of the piston 20.

Figure 10:
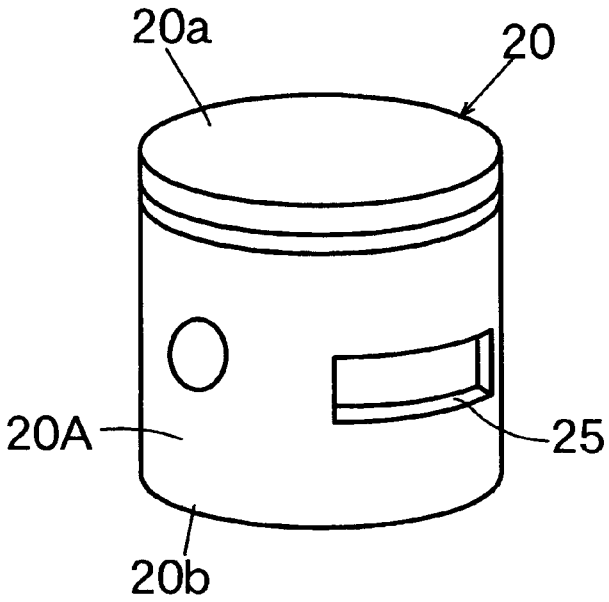
FIG. 10 is a perspective view illustrating one example of the piston to be employed in the two-stroke internal combustion engine shown in FIG. 1.

As shown in FIG. 10, the piston 20 is provided, at the skirt portion 20A thereof, with a rectangular through-hole 25, so as to enable the scavenging inlet ports 30*b*, formed at the upstream ends of the scavenging passageways 30, to communicate with the crank chamber 18.

Figure 11:
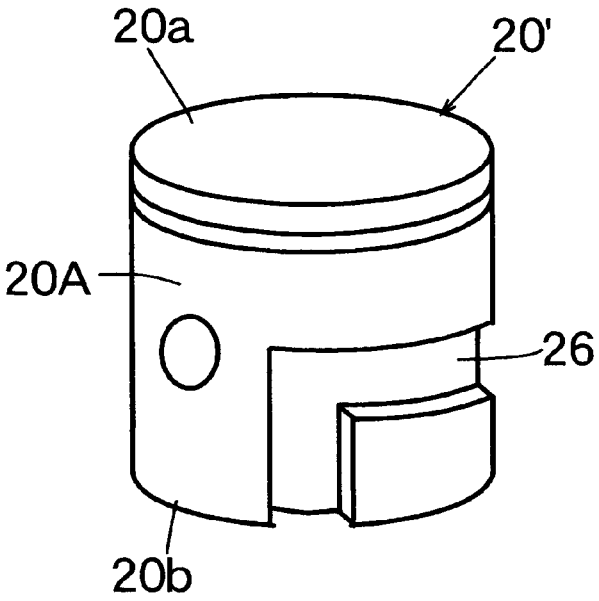
FIG. 11 is a perspective view illustrating another example of the piston to be employed in the two-stroke internal combustion engine shown in FIG. 1.

Alternatively, a horizontally inclined U-shaped or an L-shaped communication groove 26 as shown in FIG. 11 may be provided in place of the through-hole 25, in the skirt portion 20A of the piston 20.

In the ascending stroke of the piston 20, an air-fuel mixture M is introduced from an air-fuel mixture-generating means 40, e.g. a carburetor, into the crank chamber 18 disposed below the piston 20 and reserved through the intake port 33 in the crank chamber 18.

Figure 1:
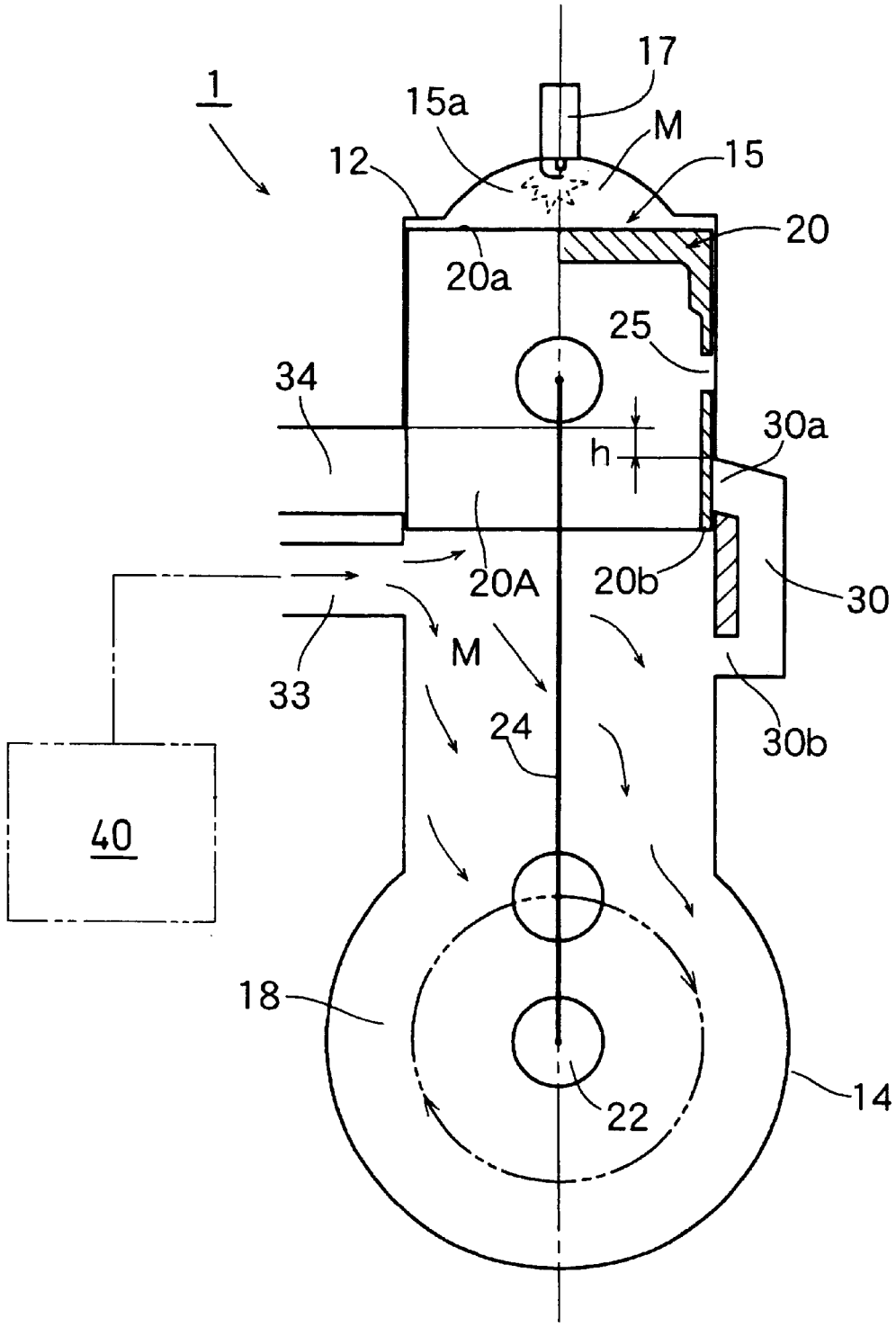
FIG. 1 is a longitudinal sectional view schematically illustrating one embodiment of the two-stroke internal combustion engine according to the present invention, wherein the piston is positioned at the top dead center.
Figure 2:
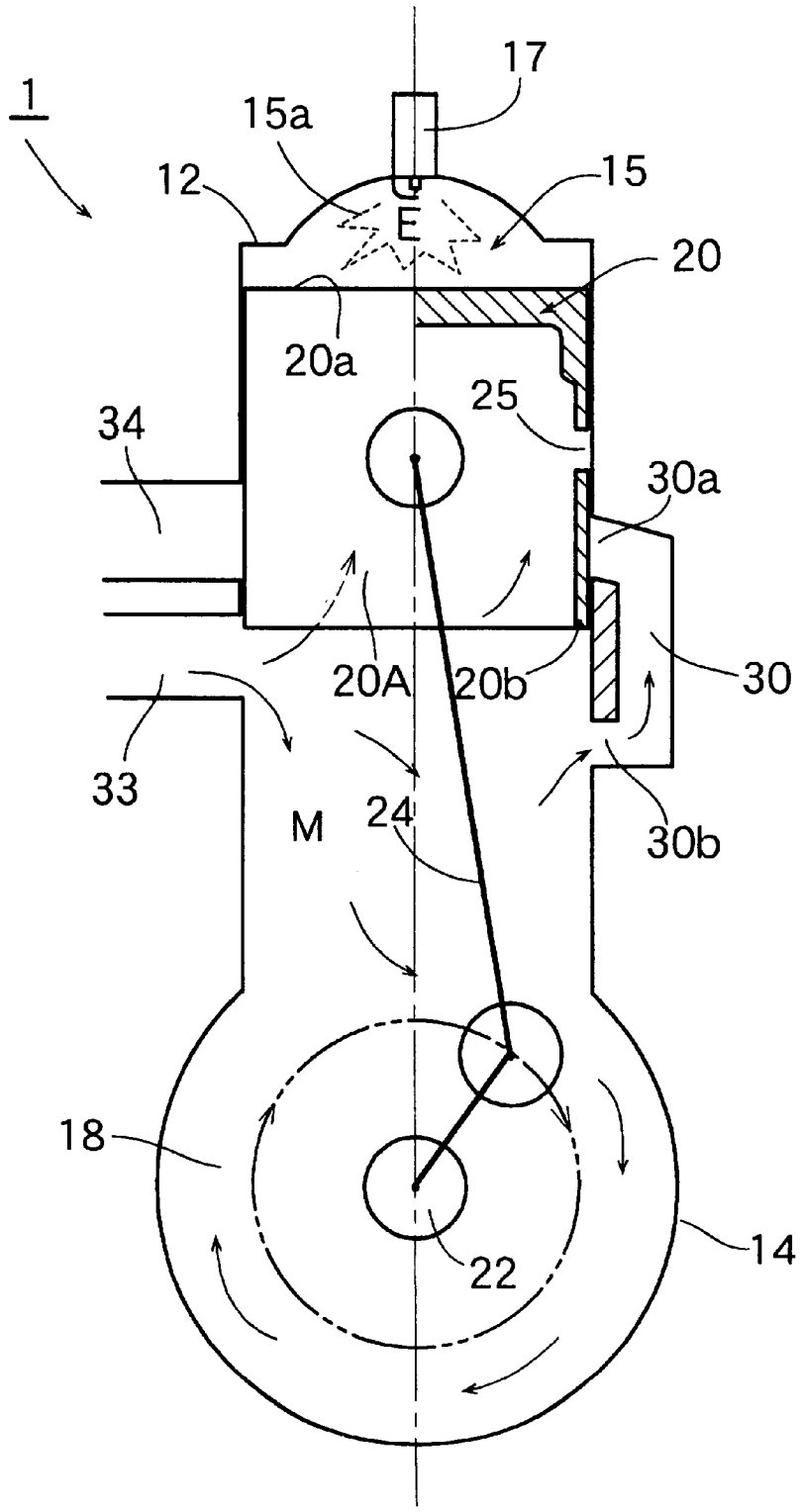
FIG. 2 is a longitudinal sectional view schematically illustrating a state wherein the piston of the two-stroke internal combustion engine of FIG. 1 is slightly descended from the top dead center.
Figure 3:
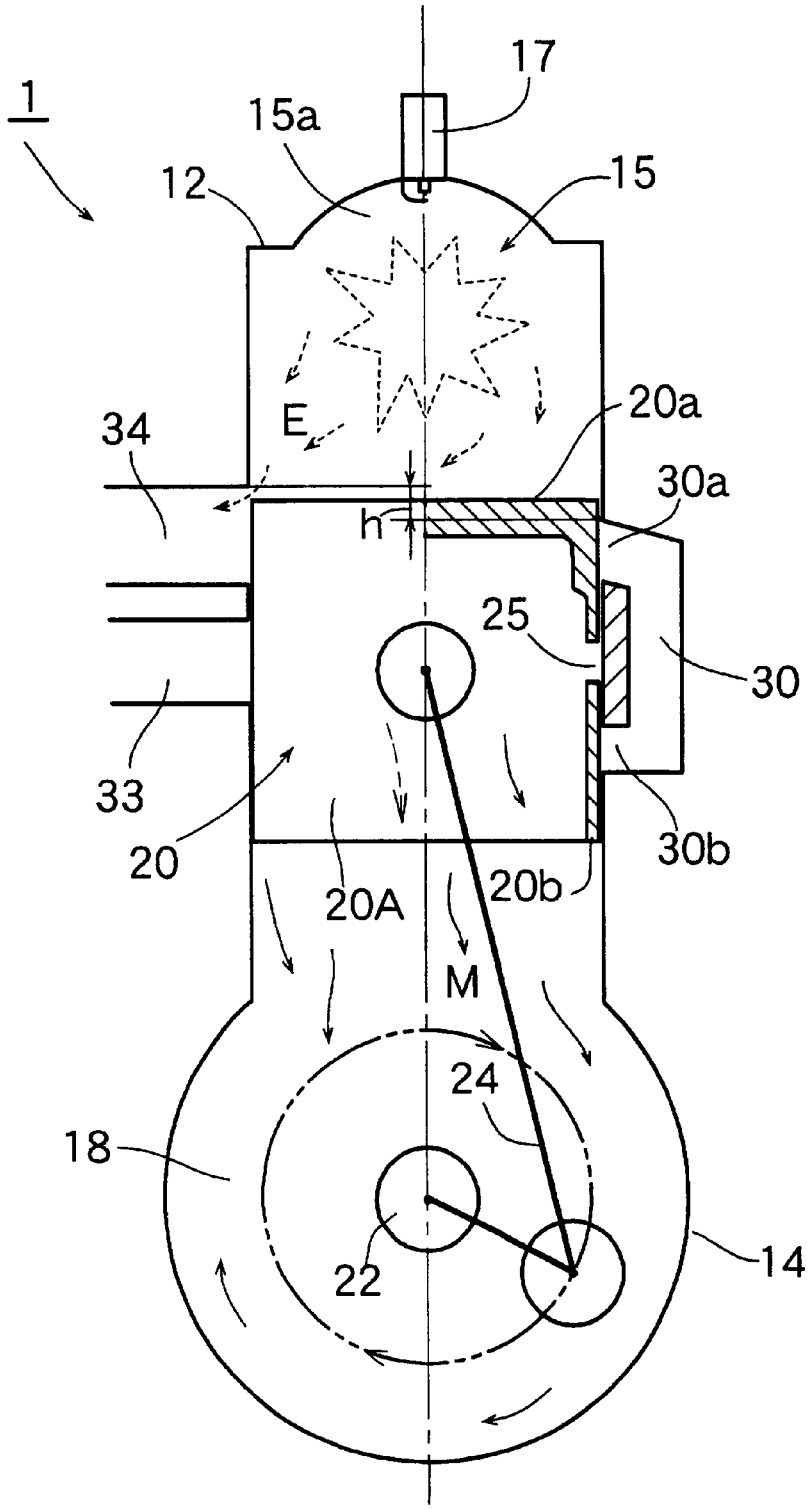
FIG. 3 is a longitudinal sectional view schematically illustrating a state wherein the piston of the two-stroke internal combustion engine of FIG. 1 is descended to such an extent that the exhaust port thereof is begun to open.

As shown in FIG. 1, when the air-fuel mixture M, which is compressed and existing inside the combustion actuating chamber 15 disposed above the piston 20, is ignited and explodes, combustion exhaust gas E is generated and the piston 20 begins to descend (see FIG. 2). In the descending stroke of the piston 20, the air-fuel mixture M existing inside the crank chamber 18 is compressed by the piston 20, and at the same time, as shown in FIG. 3, the exhaust port 34 is opened at first to thereby permit the combustion exhaust gas E to be discharged into the atmosphere through the exhaust port 34.

Figure 4:
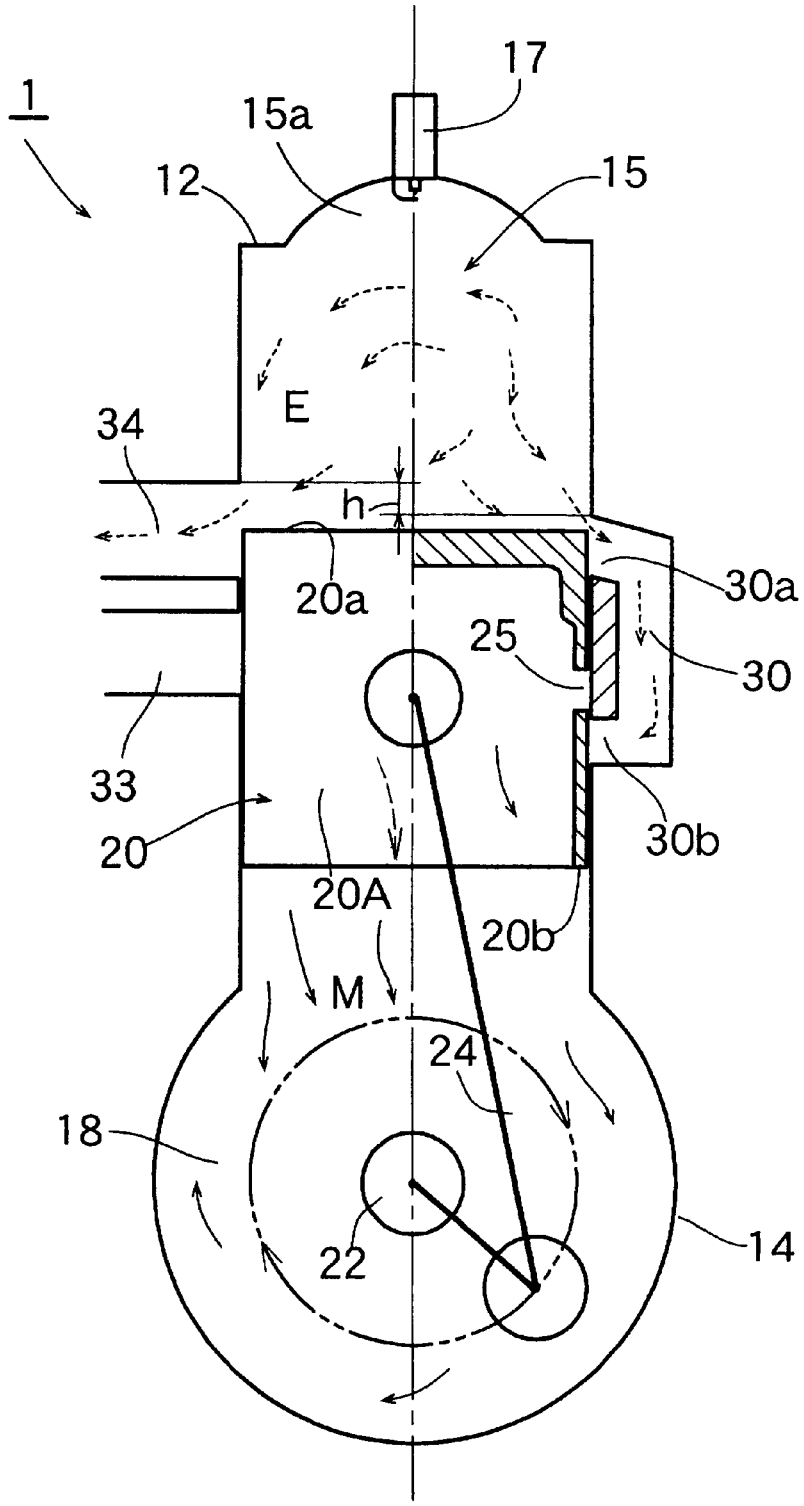
FIG. 4 is a longitudinal sectional view schematically illustrating a state wherein the piston of the two-stroke internal combustion engine of FIG. 1 is descended to such an extent that the scavenging outlet port thereof begins to open.

As the piston 20 descends, the scavenging outlet ports 30*a* provided at the downstream end of the scavenging passageways 30 open, as shown in FIG. 4. At this moment, the scavenging inlet ports 30*b* of the scavenging passageways 30 are kept closed by the skirt portion 20A of the piston 20. Since the combustion gas (combustion exhaust gas) E, generated from the aforementioned explosive burning and existing inside the combustion actuating chamber 15, has higher pressure than the pressure acting on the air-fuel mixture M inside the scavenging passageways 30, part of the combustion exhaust gas E is permitted to be blown down from the scavenging outlet ports 30 and hence permitted to be introduced into and stored in the scavenging passageways 30.

Figure 5:
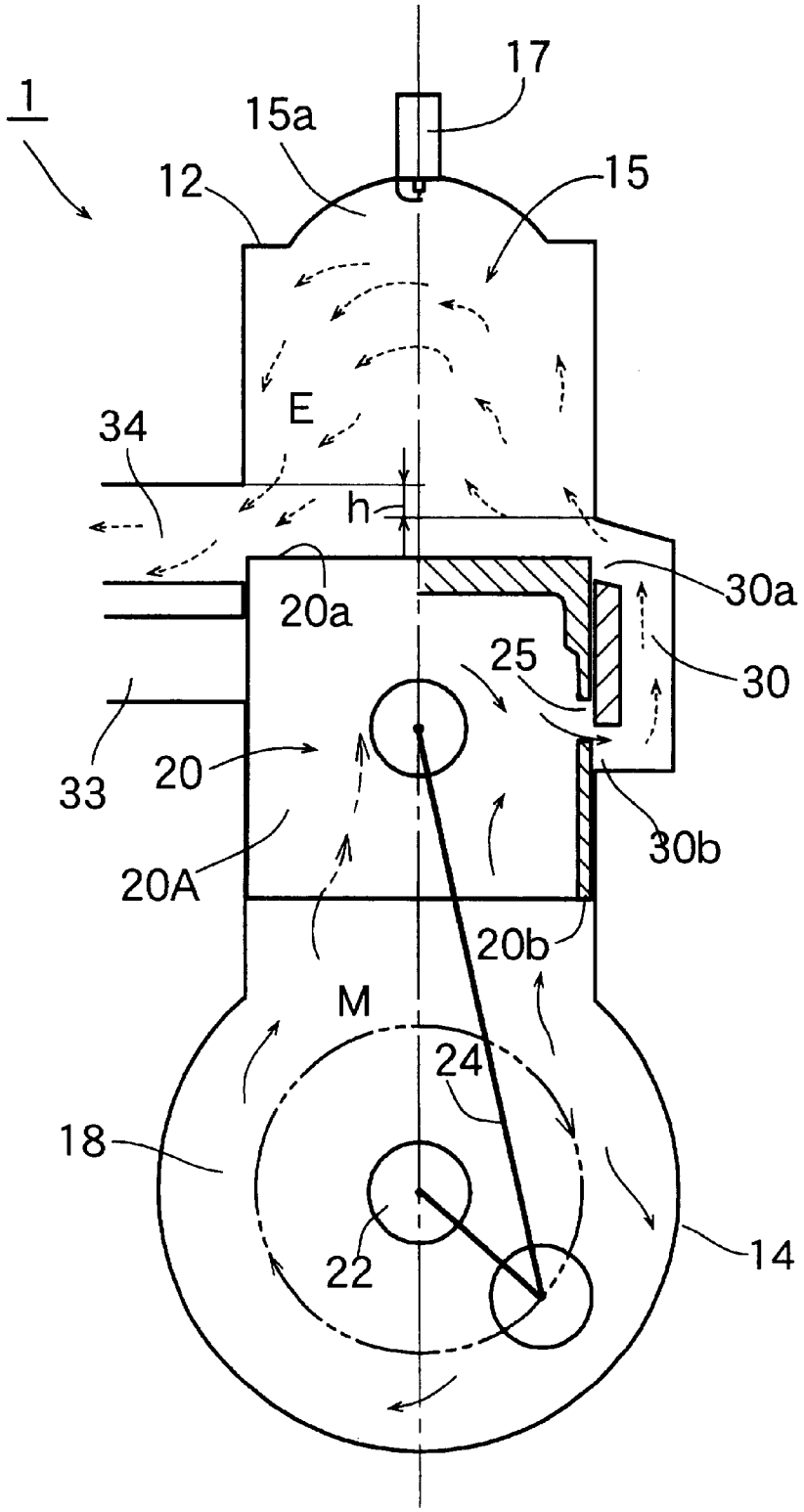
FIG. 5 is a longitudinal sectional view schematically illustrating a state wherein the piston of the two-stroke internal combustion engine of FIG. 1 is descended to such an extent that the through-hole of the piston begins to open to the scavenging inlet port.
Figure 6:
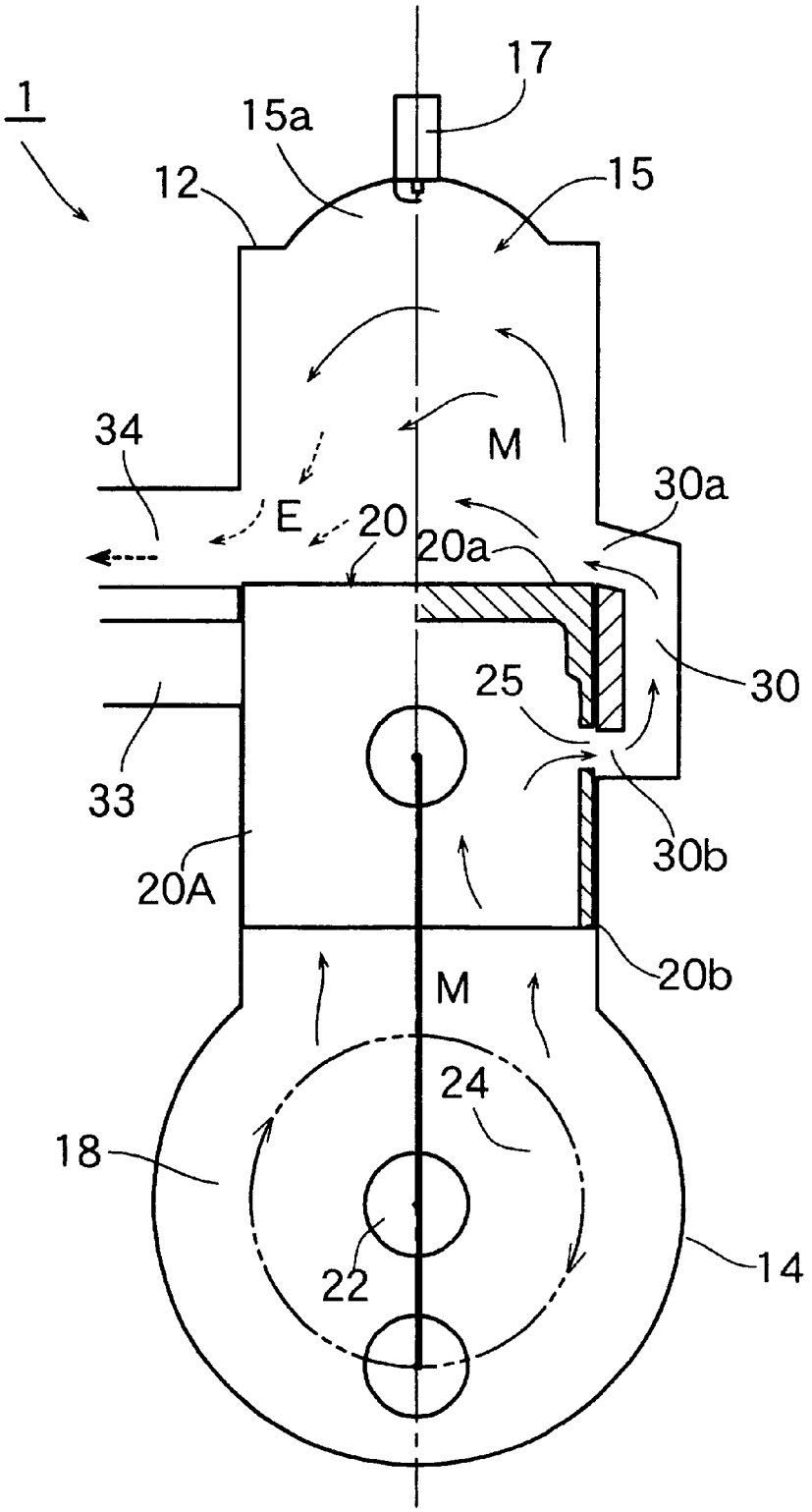
FIG. 6 is a longitudinal sectional view schematically illustrating a state wherein the piston of the two-stroke internal combustion engine of FIG. 1 is positioned at the bottom dead center.
Figure 7:
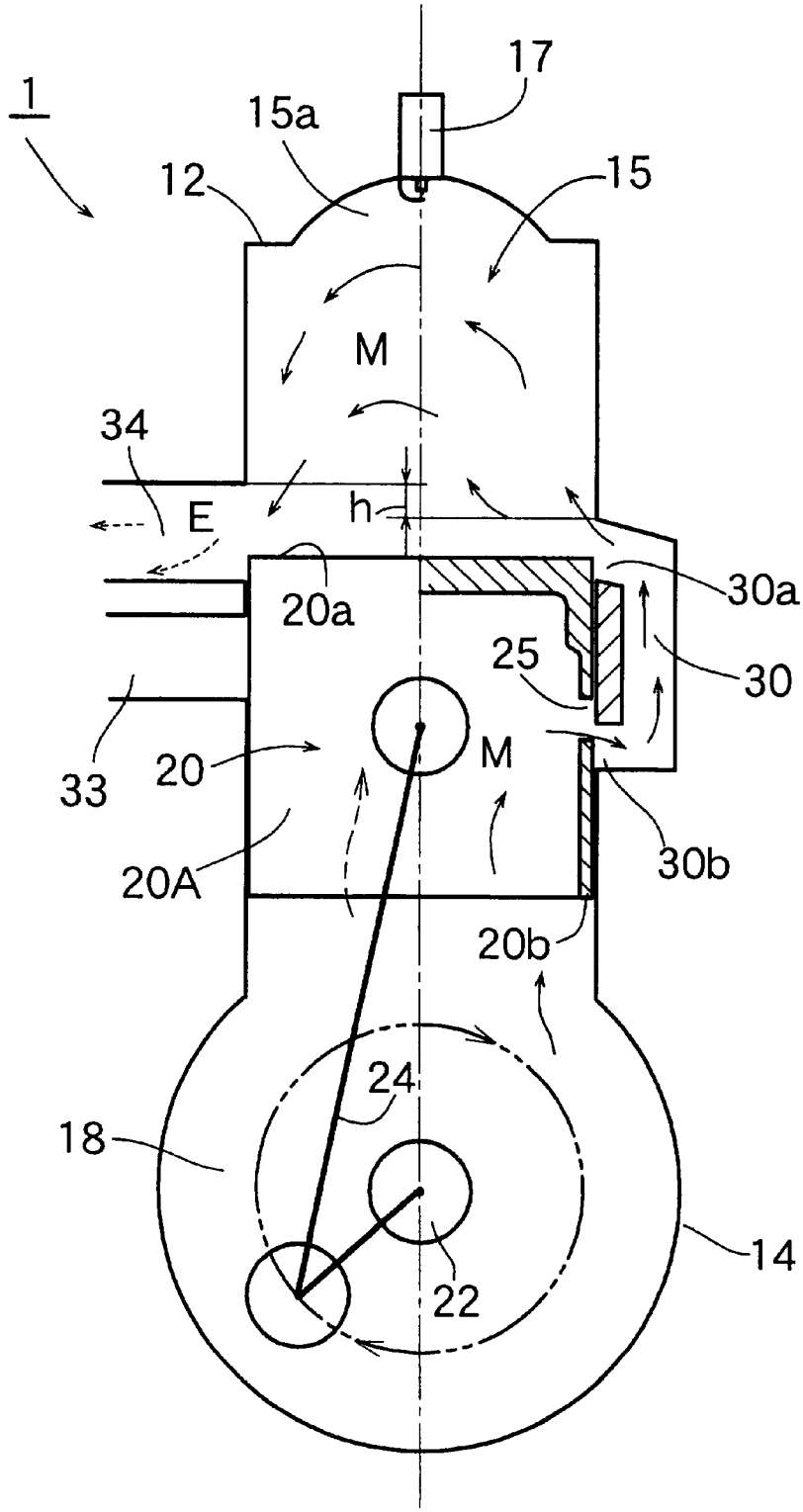
FIG. 7 is a longitudinal sectional view schematically illustrating a state wherein the piston of the two-stroke internal combustion engine of FIG. 1 is slightly ascended from the bottom dead center.

When the piston 20 further descends, the scavenging inlet ports 30*b* are opened through the through-hole 25 provided at the skirt portion 20A of the piston 20 as shown in FIG. 5, thereby allowing an air-fuel mixture M that has been pre-compressed in the crank chamber 18, to be introduced, via the through-hole 25 and the scavenging inlet ports 30*b*, into the scavenging passageways 30. As a result, the combustion exhaust gas E existing inside the scavenging passageways 30 and the combustion actuating chamber 15 is pushed out therefrom toward the exhaust port 34 by the scavenging flow of the air-fuel mixture M that has been blown out of the scavenging outlet ports 30*a* during a period starting from the moment when the piston 20 begins to ascend (FIG. 7) from the bottom dead center (FIG. 6) until the scavenging outlet ports 30*a* are closed, as shown in FIG. 8. In other words, following the outflow of the combustion exhaust gas E, the air-fuel mixture M is also permitted to be introduced into the combustion actuating chamber 15, from the scavenging passageways 30, thereby enabling all of the combustion exhaust gas E, including the gas that has been introduced in advance into the combustion actuating chamber 15, to be blown out toward the exhaust port 34 (see also FIG. 9).

According to the present invention, the scavenging (by making use of the combustion exhaust gas E) is performed by deliberately delaying the scavenging-initiating timing from the exhaust-initiating timing (the timing to open the exhaust port 34). Following the scavenging, a high-pressure fresh air (air-fuel mixture) M that has been pre-compressed is introduced at a stretch into the combustion actuating chamber 15.

Figure 12:
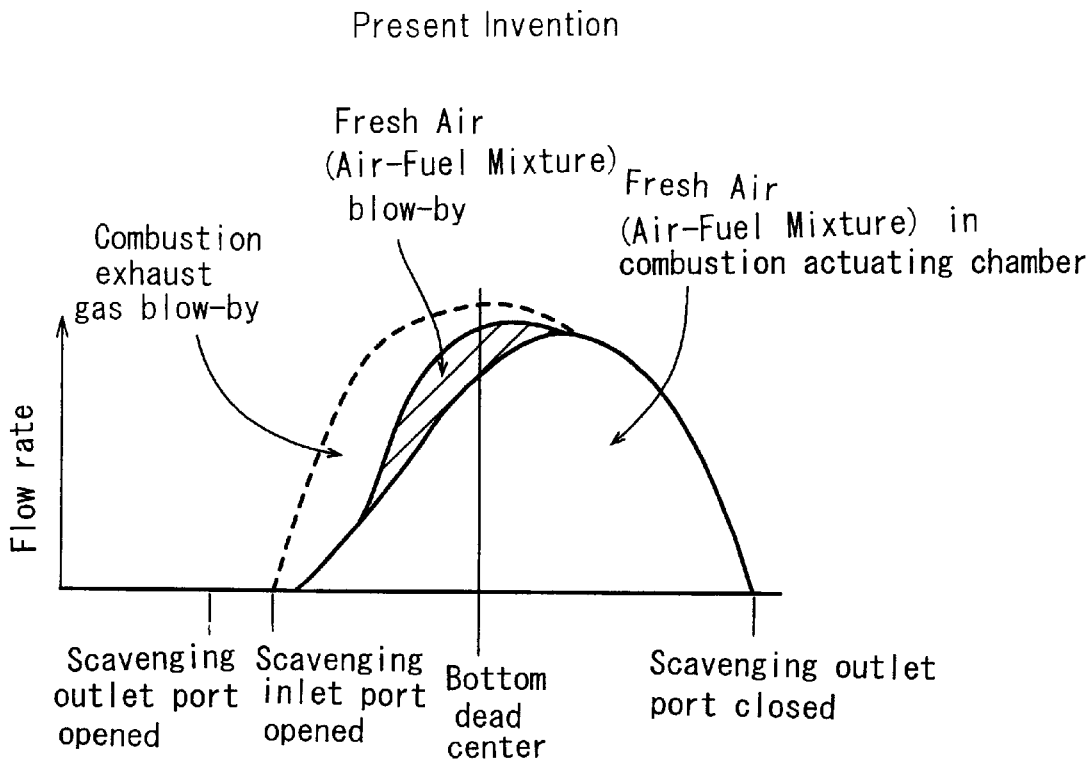
FIG. 12 is a graph illustrating the characteristics of the two-stroke internal combustion engine shown in FIG. 1.
Figure 13:
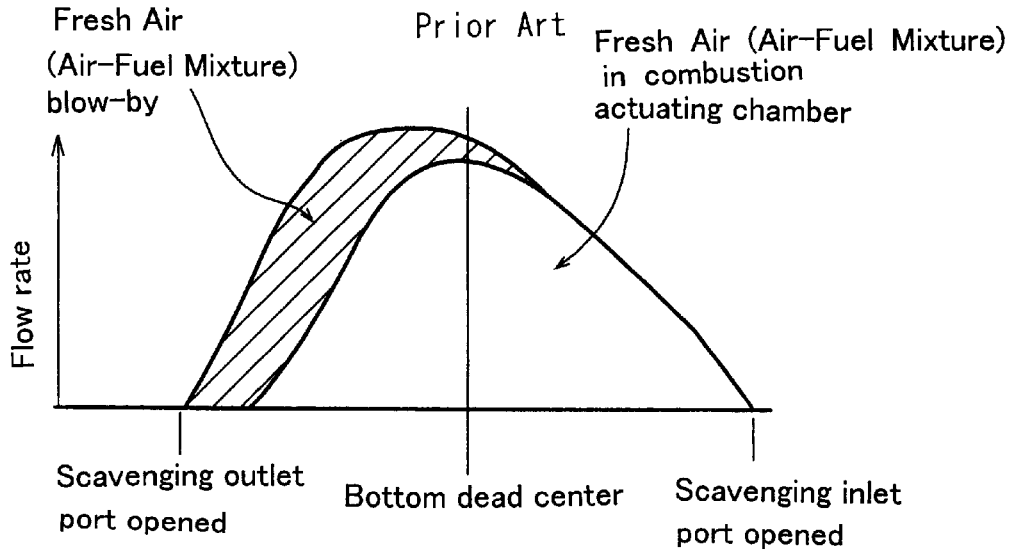
FIG. 13 is a graph illustrating the characteristics of the two-stroke internal combustion engine according to the prior art.

In this case, according to the conventional two-stroke internal combustion engine where the air-fuel mixture is employed as a scavenging flow, since the portion indicated by the hatched region (area) in FIG. 13 corresponds to the quantity of so-called blow-by of fresh air (air-fuel mixture), a fairly large quantity of air-fuel mixture is permitted to blow by. Conversely, according to the two-stroke internal combustion engine 1 of the present invention, when the combustion exhaust gas is employed in place of the air-fuel mixture as a scavenging flow, the quantity of blow-by of air-fuel mixture can be greatly reduced, as indicated by the hatched region (area) in FIG. 12, corresponding to the quantity of so-called blow-by of fresh air (air-fuel mixture).

Therefore, according to the two-stroke internal combustion engine 1 of the present invention, the quantity of so-called blow-by or the quantity of air-fuel mixture to be discharged without being utilized for the combustion can be reduced to a minimum, thus making it possible to improve fuel consumption and engine power, and minimize the amount of poisonous components in the exhaust gas.

Furthermore, the two-stroke internal combustion engine of the present invention can be manufactured by slightly modifying the piston (drilling a through-hole, etc. therein), so that the conventional structure of the engine would not be significantly altered. Therefore, it is possible to also reduce the manufacturing cost of the engine.

Additionally, according to the prior art, it has been generally tried to narrow the timings of suction and exhaust (timing area) so as to reduce the amount of exhaust gas as a whole (the engine power would be inevitably lowered) in order to minimize the existence of poisonous substances in the exhaust gas (exhaust emission). According to the present invention, it is no longer absolutely required to reduce the amount of exhaust gas. Furthermore, since air is no longer permitted to be introduced into the engine, it is now possible to prevent the combustion stability from deteriorating and to facilitate the engine setting.

Figure 14:
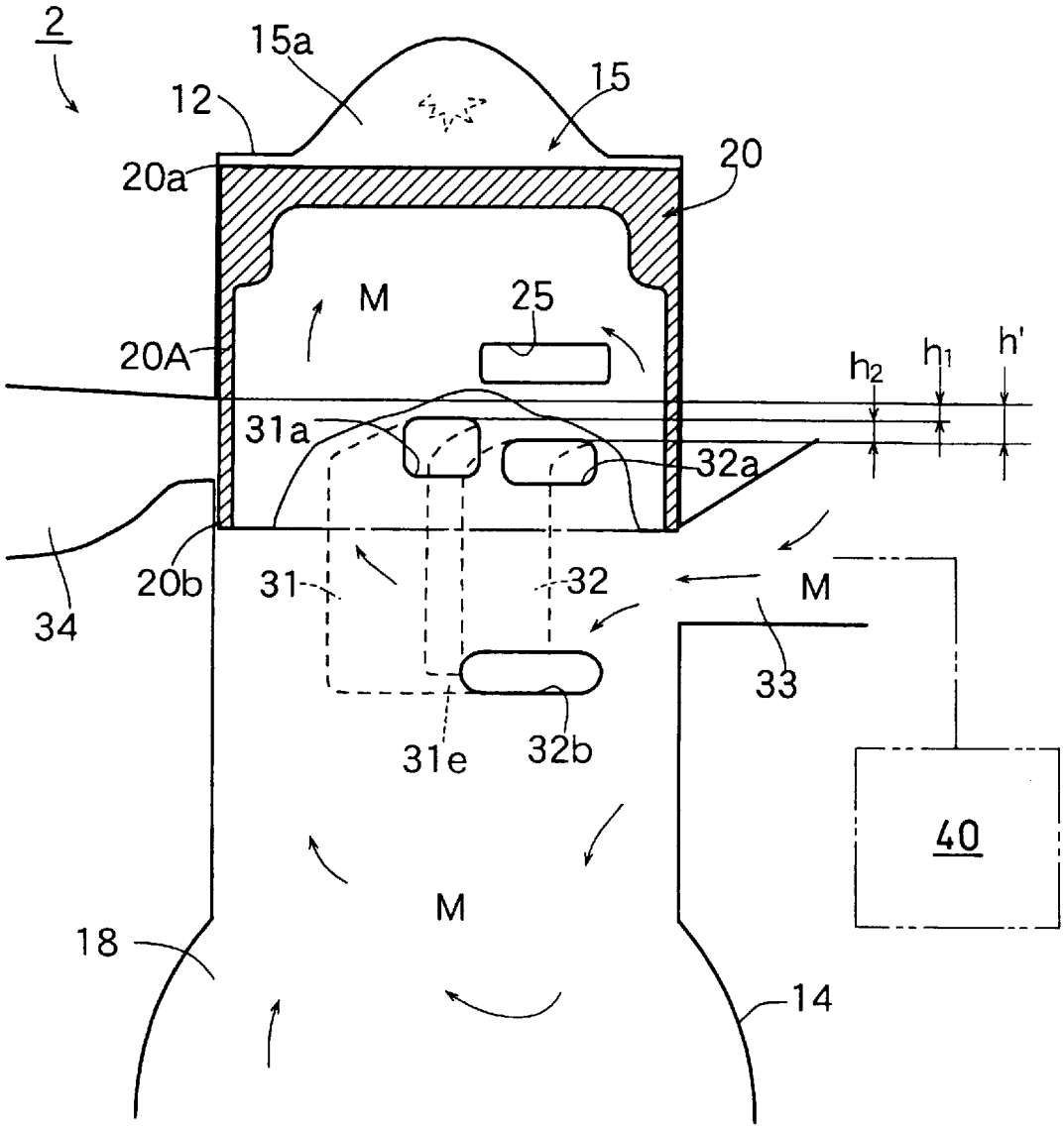
FIG. 14 is a schematic longitudinal sectional view, taken along a plane splitting the exhaust port of the two-stroke internal combustion engine according to a second embodiment of the present invention, wherein the piston is positioned at the top dead center.
Figure 19:
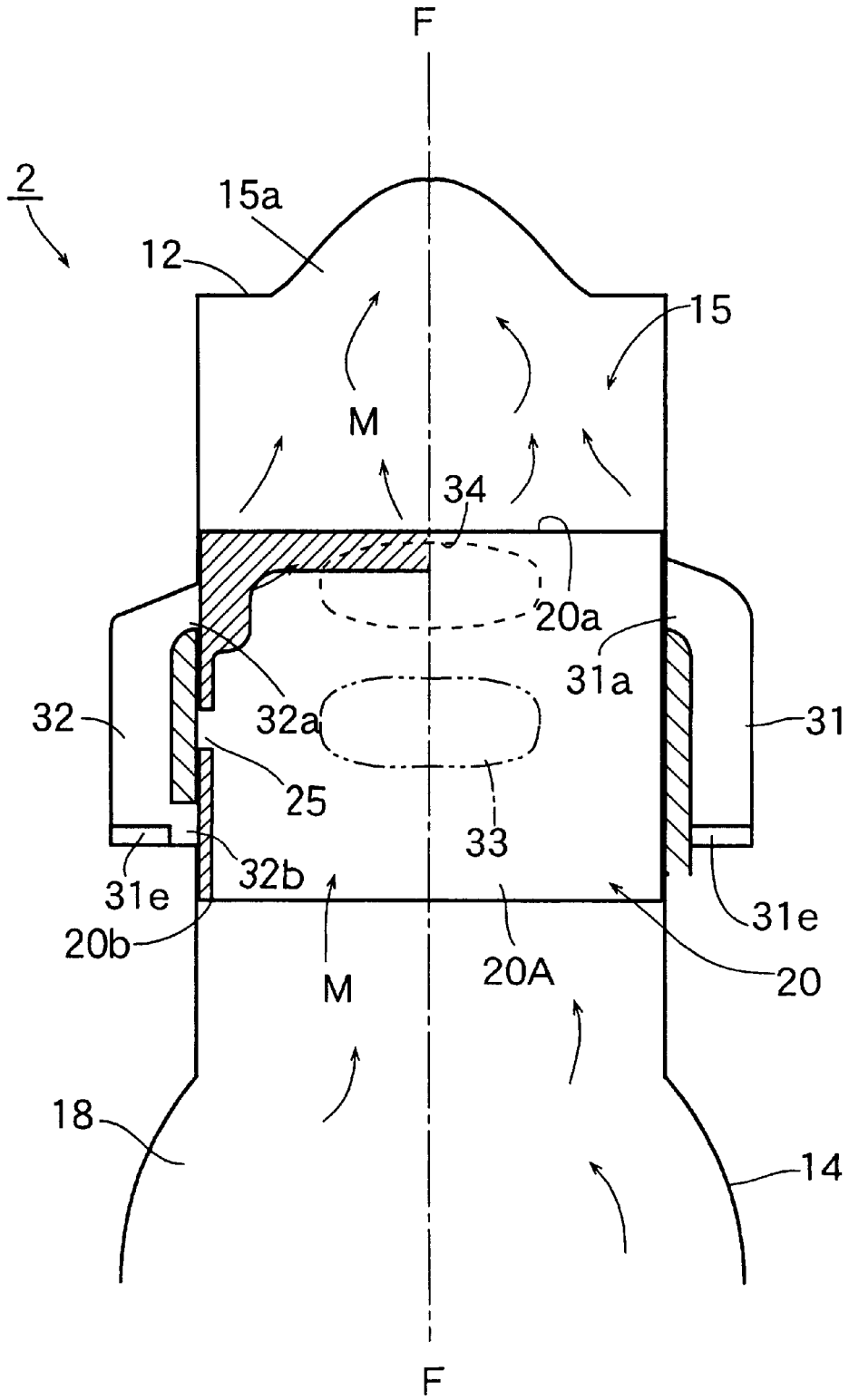
FIG. 19 is a longitudinal sectional view schematically illustrating a state wherein the piston of the two-stroke internal combustion engine of FIG. 15 is ascended from the bottom dead center to such an extent that the first scavenging outlet port as well as the second scavenging outlet port thereof are closed.
Figure 20:
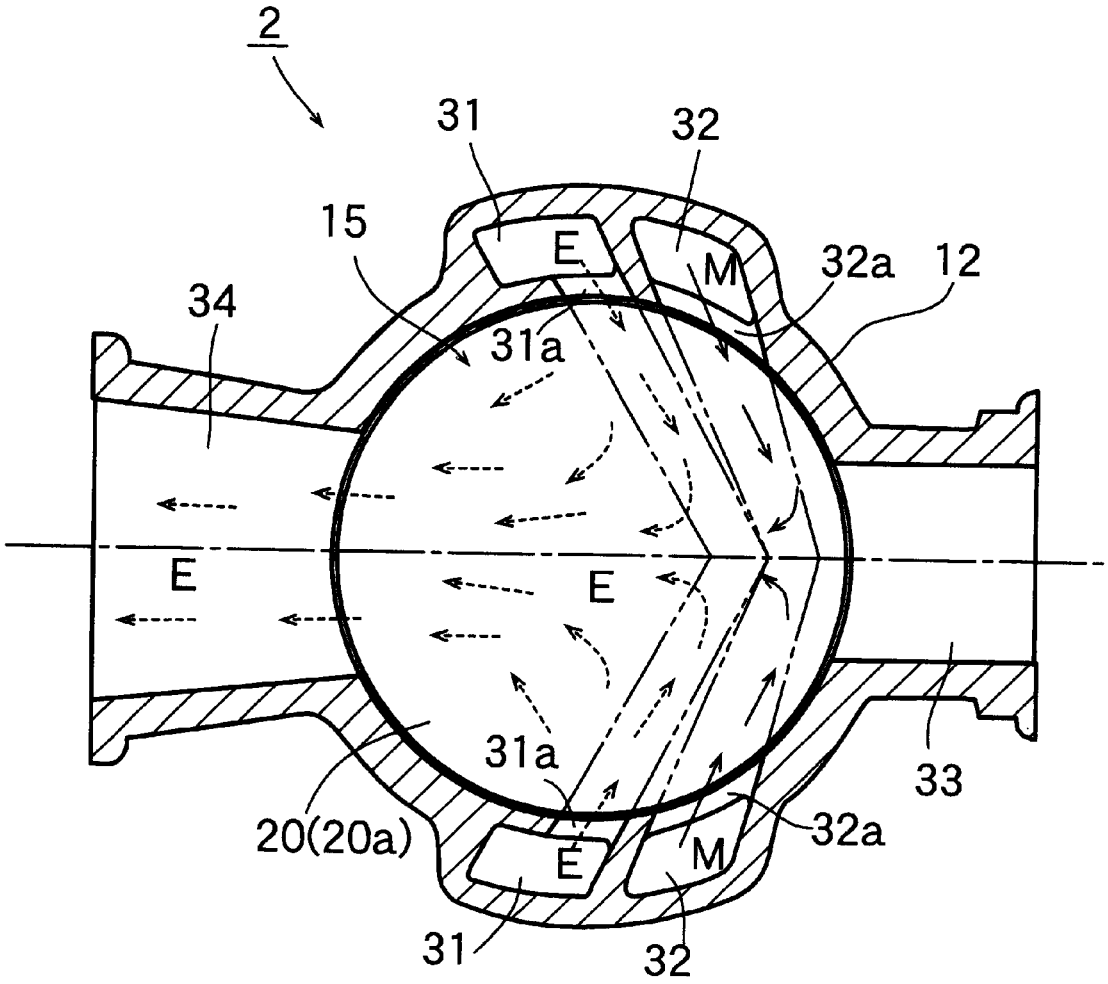
FIG. 20 is a cross-sectional view illustrating the two-stroke internal combustion engine shown in FIG. 14.

FIG. 14 illustrates a second embodiment of the two-stroke internal combustion engine according to the present invention, wherein the exhaust port 34 and the intake port 33 are both split into two parts. FIGS. 15 through 19 respectively show a schematic longitudinal sectional view of the two-stroke internal combustion engine shown in FIG. 14. FIG. 20 is a schematic cross-sectional view taken along a line passing through the exhaust port 34.

For easier explanation, in FIGS. 15 through 19, a longitudinal sectional view passing through a second scavenging passageway 32 is shown on the left side, while a longitudinal sectional view passing through a first scavenging passageway 31 is shown on the right side, where these sectional views are combined with each other in each figure. Preferably, a pair of the first scavenging passageways 31, as well as a pair of the second scavenging passageways 32 are disposed on the right and left sides, respectively. Further, in FIG. 20, the exhaust port 34 and the intake port 33 are shown such that they are positioned at the same level. Preferably, the intake port 33 is placed, in the vertical direction, lower than the exhaust port 34.

In FIGS. 14 through 20, the portions or members which correspond in structure with the counterparts of the two-stroke internal combustion engine 1 according to the aforementioned first embodiment will be identified by the same reference numbers, thereby omitting a duplicated explanation thereof. Therefore, in the following explanation, only the features which differ from the aforementioned first embodiment will be explained.

In the two-stroke internal combustion engine 2 according to the second embodiment shown in these figures, a pair of first scavenging passageways 31 which are disposed close to the exhaust port 34, and a pair of second scavenging passageways 32 which are disposed away from the exhaust port 34, both pairs of scavenging passageways forming the Schnürle-type scavenging system, are symmetrically provided on both sides of the longitudinal section F which figuratively divides the exhaust port 34 into two equal parts so as to permit the combustion actuating chamber 15, disposed above the piston 20, to communicate with the crank chamber 18. Additionally, the piston 20 is provided, at the skirt portion 20A thereof, with a through-hole 25 in the same manner as in the aforementioned first embodiment so as to enable the second scavenging inlet ports 32*b* formed at the upstream end of each of the second scavenging passageways 32 to communicate with the crank chamber 18.

Furthermore, the upstream end of the first scavenging passageway 31 communicates, via a throttle passageway 31*e*, with the corresponding second scavenging passageway 32.

In this case, the first scavenging outlet ports 31*a* are disposed at a level which is lower than the exhaust port 34 by a distance of "h1", while the second scavenging outlet ports 32*a* are disposed at a level which is lower than the exhaust port 34 by a distance of "h" and also lower than the first scavenging outlet ports 31*a* by a distance of "h2".

According to the two-stroke internal combustion engine 2 of this embodiment constructed as described above, in the ascending stroke of the piston 20, an air-fuel mixture M is introduced from an air-fuel mixture-generating means 40, e.g., a carburetor, into the crank chamber 18 disposed below the piston 20 and reserved in the crank chamber 18.

Figure 15:
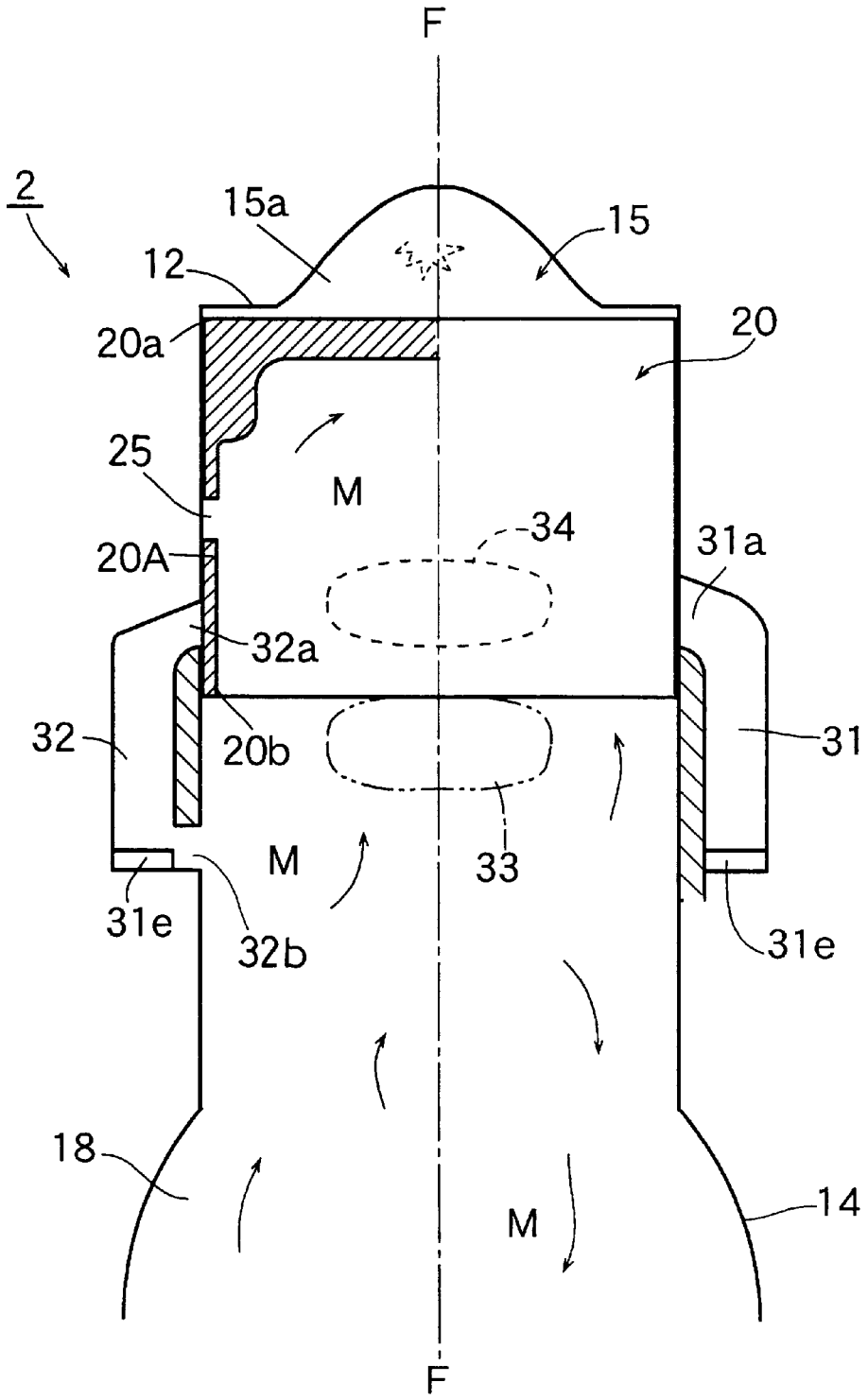
FIG. 15 is a schematic longitudinal sectional view, taken along a plane orthogonally intersecting the exhaust port of the two-stroke internal combustion engine shown in FIG. 14, wherein the piston is positioned at the top dead center.
Figure 16:
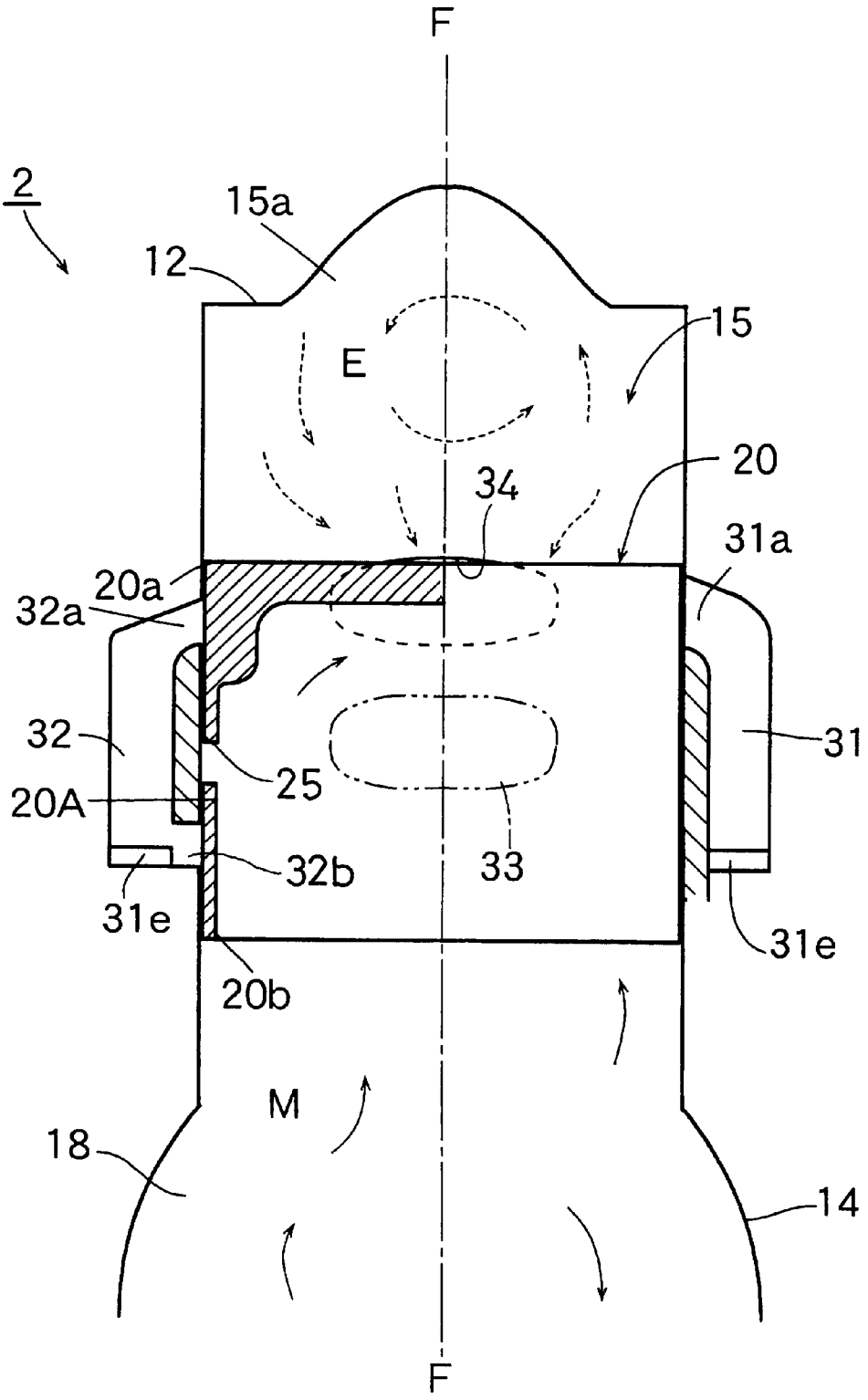
FIG. 16 is a longitudinal sectional view schematically illustrating a state wherein the piston of the two-stroke internal combustion engine of FIG. 15 is descended to such an extent that the exhaust port thereof begins to open.

As shown in FIGS. 14 and 15, when the air-fuel mixture M, existing inside the combustion actuating chamber 15 disposed above the piston 20, is ignited and explodes, combustion exhaust gas E is generated and the piston 20 begins to descend. In the descending stroke of the piston 20, the air-fuel mixture M existing inside the crank chamber 18 is compressed by the piston 20, and at the same time, as shown in FIG. 16, the exhaust port 34 is opened first to permit the combustion exhaust gas E to be discharged into the atmosphere.

Figure 17:
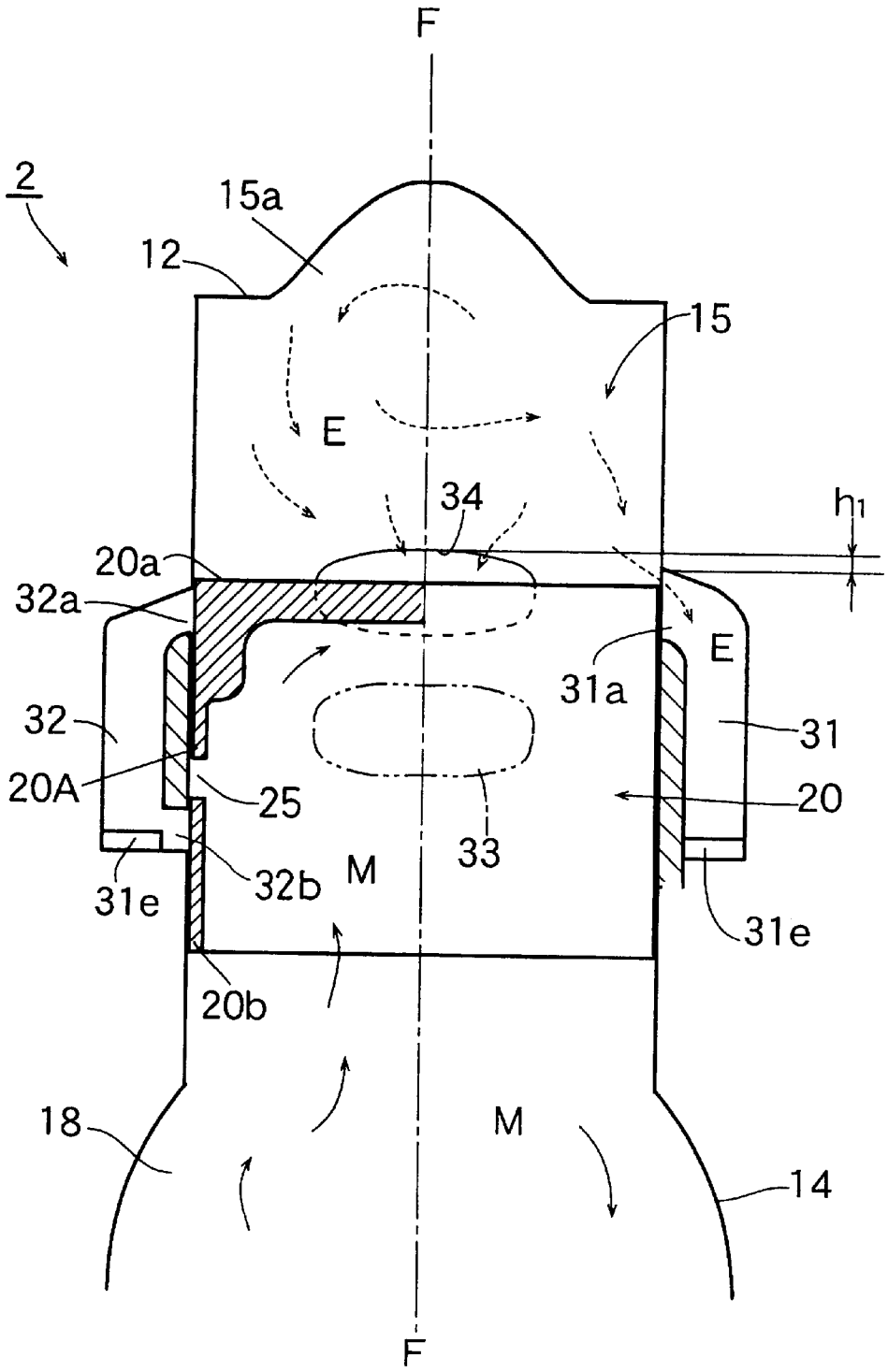
FIG. 17 is a longitudinal sectional view schematically illustrating a state wherein the piston of the two-stroke internal combustion engine of FIG. 15 is descended to such an extent that the first scavenging outlet port thereof begins to open.

When the piston 20 further descends, the first scavenging outlet ports 31*a* provided at the downstream end of the scavenging passageways 31 are opened as shown in FIG. 17. At this moment, the second scavenging inlet ports 32*b* of the second scavenging passageways 32 are kept closed by the skirt portion 20A of the piston 20. Therefore, since the combustion gas (combustion exhaust gas) E, generated from the aforementioned explosive burning and existing inside the combustion actuating chamber 15, has much higher pressure than the air-fuel mixture M inside the first scavenging passageways 31, part of the combustion exhaust gas E is permitted to be introduced into and stored in the scavenging passageways 30 from the first scavenging outlet ports 31*a*.

Figure 18:
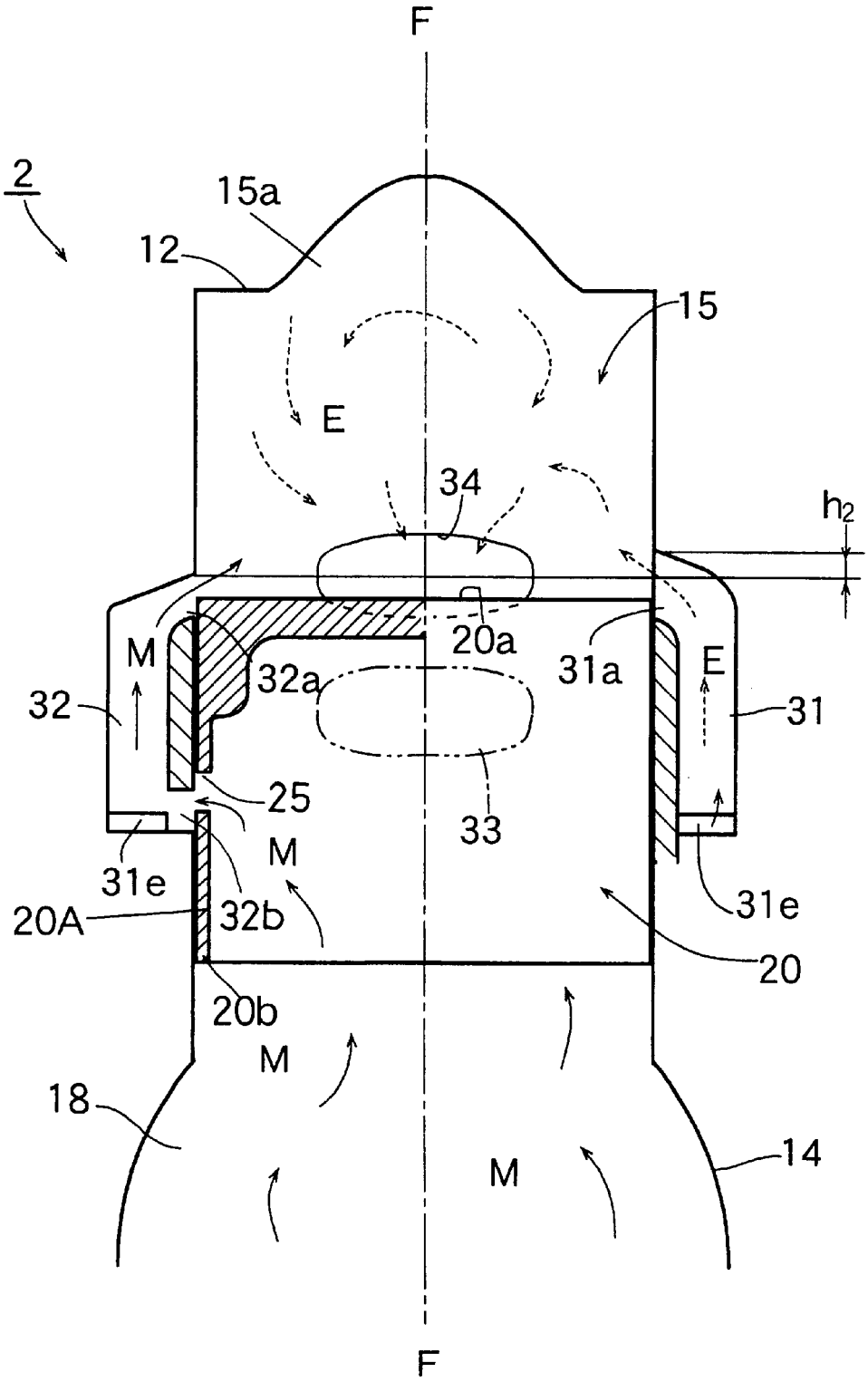
FIG. 18 is a longitudinal sectional view schematically illustrating a state wherein the piston of the two-stroke internal combustion engine of FIG. 15 is descended to such an extent that the second scavenging outlet port thereof begins to open.

Subsequently, when the piston 20 still further descends, the second scavenging inlet ports 32*b* are opened via the through-hole 25 as shown in FIG. 18, and at the same time, the second scavenging outlet ports 32*a* are also opened.

As a result, the air-fuel mixture M is permitted to flow from the crank chamber 18 so as to be introduced, via the through-hole 25 and the second scavenging inlet ports 32*b*, into the second scavenging passageways 32, and also into the first scavenging passageways 31 through the throttle passageways 31*e*. In this case, the combustion exhaust gas E existing inside the first scavenging passageways 31 is permitted to be introduced as a scavenging flow into the combustion actuating chamber 15 prior to the introduction of the air-fuel mixture M into the combustion actuating chamber 15. Concurrently, the air-fuel mixture M existing inside the second scavenging passageways 32 is also introduced into the combustion actuating chamber 15.

In this case, as clearly shown in FIG. 20, since the scavenging flow of the combustion exhaust gas E being fed from the first scavenging passageways 31 is located closer to the exhaust port 34 than the scavenging flow of the air-fuel mixture M being fed from the second scavenging passageways 32, the combustion exhaust gas E that has been introduced into the combustion actuating chamber 15 is pushed out toward the exhaust port 34 by the air-fuel mixture M. The period of this scavenging is continued starting from the moment when the piston 20 begins to ascend from the bottom dead center until all of the first and second scavenging outlet ports 31*a* and 32*a* are entirely closed as shown in FIG. 19.

As a result of the aforementioned structure, in the two-stroke internal combustion engine 2 of this embodiment, the quantity of so-called blow-by, or the quantity of air-fuel mixture to be discharged without being utilized for combustion can be reduced to a minimum, thus making it possible to improve fuel consumption and the engine power, and to minimize the amount of poisonous components in exhaust gas.

Additionally, according to the prior art, it has been generally tried to narrow the timings of suction and exhaust (timing area) so as to reduce the amount of exhaust gas as a whole in order to minimize the amount of poisonous substances in the exhaust gas (exhaust emission). According to the present invention, however, it is no longer absolutely required to reduce the amount of exhaust gas. Furthermore, since air is no longer permitted to be introduced into the engine, it is now possible to prevent the combustion stability from deteriorating, and to facilitate the engine setting.

As seen from the above explanation, it is possible, according to the present invention, to minimize so-called blow-by, or the quantity of air-fuel mixture discharged without being utilized for combustion, without extensively altering the structure of the conventional engine. Additionally, it is possible to improve the fuel consumption and engine power, minimize the amount of poisonous components in the exhaust gas, and reduce the manufacturing cost of the engine.

Although the invention has been described herein by reference to specific embodiments thereof, it will be understood that such embodiments are susceptible of modification and variation without departing from the inventive concepts disclosed. All such modifications and variations, therefore, are intended to be included within the spirit and scope of the appended claims.

What is claimed is:

1. A two-stroke internal combustion engine, comprising:

(a) a cylinder;

(b) a piston fittingly inserted into said cylinder for reciprocating movement therein;

(c) a crankcase hermetically and contiguously disposed below said cylinder and defining a crank chamber; said crankcase adjoining said cylinder;

(d) a combustion actuating chamber disposed above and communicating with said cylinder;

(e) an exhaust port provided in a sidewall of said cylinder;

(f) means for forming air-fuel mixture;

(g) one or more pairs of Schnürle-type scavenging passageways, each scavengin passageway having an upstream end and a downstream end, allowing said combustion actuating chamber to communicate with said crankcase, and symmetrically provided on both sides of the longitudinal section which figuratively divides said exhaust port into two equal parts;

(h) a through-hole or a communication groove provided at a skirt portion of said piston, enabling a scavenging inlet port provided at the upstream end of each of said scavenging passageways to communicate with said crank chamber;

said air-fuel mixture-forming means allowing the air-fuel mixture to be introduced therefrom into said crank chamber;

said exhaust port being positioned to be first opened in the descending stroke of said piston before the scavenging inlet port is opened;

a combustion exhaust gas originating from said combustion actuating chamber being enabled to be introduced into each scavenging passageway via a scavenging outlet port provided at said downstream end of each scavenging passageway, while the skirt portion of said piston closes the scavenging inlet port at the upstream end of said scavenging passageway; and an air-fuel mixture being subsequently introduced in synchronization with the descending stroke from said crankcase, via said through-hole or said communication groove, into each scavenging passageway;

whereby the combustion exhaust gas existing inside each scavenging passageway is forced into said combustion actuating chamber by the air-fuel mixture introduced into the scavenging passageway.

2. The two-stroke internal combustion engine according to claim 1, wherein in the descending stroke of said piston, each scavenging outlet port is opened after said exhaust port is opened and is followed by the opening of each scavenging inlet port through said through-hole or said communication groove.

3. A two-stroke internal combustion engine, comprising:

(a) a cylinder;

(b) a piston fittingly inserted into said cylinder for reciprocating movement therein;

(c) a crankcase hermetically and contiguously disposed below said cylinder and defining a crank chamber; said crankcase adjoining said cylinder;

(d) a combustion actuating chamber disposed above and communicating with said cylinder;

(e) an exhaust port provided in a sidewall of said cylinder;

(f) means for forming air-fuel mixture;

(g) a pair of first Schnürle-type scavenging passageways located in the proximity to said exhaust port;

(h) a pair of second Schnürle-type scavenging passageways located away from said exhaust port;

(i) each of said scavenging passageways allowing said combustion actuating chamber to communicate with said crankcase;

(j) said first and second pairs of scavenging passageways being symmetrically provided on both sides of a longitudinal section which figuratively divides said exhaust port into two equal parts;

(k) a through-hole or a communication groove provided at a skirt portion of said piston to thereby enable a second scavenging inlet port provided at an upper end of each of said second Schnürle-type scavenging passageways to communicate with said crank chamber;

(l) a throttle passageway communicating an upper end of each of said first scavenging passageway to a respective one of said second scavenging passageway;

said air-fuel mixture-forming means allowing air-fuel mixture to be introduced therefrom into said crank chamber, said exhaust port being positioned to be first opened in the descending stroke of the piston before said scavenging ports are opened, a combustion exhaust gas originating from said combustion actuating chamber being introduced into said first scavenging passageways via a first scavenging outlet port provided at said downstream end of each of said first scavenging passageways, while the skirt portion of said piston closes the second scavenging inlet port, the air-fuel mixture fed from said crankcase being subsequently introduced into each of said second scavenging passageways via said through-hole or said communication groove and said second scavenging inlet port, and also into each of said first scavenging passageways via said throttle passageway, and the combustion exhaust gas existing inside each of said first scavenging passageways being introduced into said combustion actuating chamber prior to the introduction thereinto of the air-fuel mixture.

4. The two-stroke internal combustion engine according to claim 3, wherein in the descending stroke of said piston, said scavenging outlet ports are opened after said exhaust port is opened, and is followed by the opening of said second scavenging inlet ports via said through-hole or said communication groove and also followed by the opening of said second scavenging outlet ports.

* * * * *